US008499954B2

(12) United States Patent
Tang

(10) Patent No.: US 8,499,954 B2
(45) Date of Patent: Aug. 6, 2013

(54) PACKING MECHANISM

(75) Inventor: Zi-Ming Tang, Shenzhen (CN)

(73) Assignees: Fu Tai Hua Industry (Shenzhen) Co., Ltd., Shenzhen (CN); Hon Hai Precision Industy Co., Ltd., New Taipei (TW)

( * ) Notice: Subject to any disclaimer, the term of this patent is extended or adjusted under 35 U.S.C. 154(b) by 5 days.

(21) Appl. No.: 13/427,917

(22) Filed: Mar. 23, 2012

(65) Prior Publication Data

US 2013/0098907 A1 Apr. 25, 2013

(30) Foreign Application Priority Data

Oct. 21, 2011 (CN) ..... 2011 1 0322697

(51) Int. Cl.
*B65D 21/08* (2006.01)

(52) U.S. Cl.
USPC ..... 220/4.01; 220/4.28; 220/4.33; 220/535; 220/489; 220/692; 220/682; 220/1.5; 206/600; 206/599; 206/386; 312/205; 108/54.1; 108/56.1

(58) Field of Classification Search
USPC ..... 220/4.33, 535, 489, 4.28, 692, 682, 220/4.34; 206/600, 599; 312/205, 7 R, 257; 108/54.1, 56.1; 52/127.1, 127.7, 127.8
See application file for complete search history.

(56) References Cited

U.S. PATENT DOCUMENTS 2,405,535 A * 8/1946 Weiss ..... 108/54.1
3,316,460 A * 4/1967 Scoville ..... 361/796
3,327,882 A * 6/1967 Andrews ..... 220/4.28
3,329,103 A * 7/1967 Cohen ..... 108/54.1
3,329,473 A * 7/1967 Dickson ..... 312/108
3,374,914 A * 3/1968 Adam ..... 220/4.28
3,374,915 A * 3/1968 Verhein et al. ..... 220/4.28
4,706,816 A * 11/1987 Fjallstrom ..... 206/525
4,907,695 A * 3/1990 Gomes et al. ..... 206/386
5,056,666 A * 10/1991 Janssens ..... 206/600
5,236,099 A * 8/1993 Fties et al. ..... 220/4.31
5,381,915 A * 1/1995 Yardley ..... 220/4.33
5,593,058 A * 1/1997 Spencer et al. ..... 220/4.31
6,076,690 A * 6/2000 Hemmerly ..... 217/43 R
7,607,542 B1 * 10/2009 Hsieh ..... 206/600
8,127,929 B1 * 3/2012 Lu et al. ..... 206/600
2006/0032411 A1 * 2/2006 Hummel et al. ..... 108/53.3
2009/0152264 A1 * 6/2009 Nakayama et al. ..... 220/4.32
2009/0188188 A1 * 7/2009 Rivet ..... 52/270
2013/0119068 A1 * 5/2013 Friedl et al. ..... 220/573.1

* cited by examiner

*Primary Examiner* — Bryon Gehman
*Assistant Examiner* — Gideon Weinerth
(74) *Attorney, Agent, or Firm* — Altis Law Group, Inc.

(57) ABSTRACT

A packing mechanism includes a plurality of first connecting members connecting end to end to form a polygon; and a plurality of sidewalls mounted on the first connecting members. Each first connecting member includes a main body, and a fixing portion mounted on an end of the main body. The main body defines at least two latching portions and at least one connecting portion. Each sidewall includes a base body and at least one positioning portion formed at an end of the base body, and the positioning portion latches with the connecting portion of the corresponding first connecting member. The fixing portion engages with one of the latching portions of an adjacent first connecting member; such that a volume of the packing mechanism is adjustable by engaging the fixing portion with another one of the latching portions of the adjacent first connecting members.

18 Claims, 8 Drawing Sheets

PACKING MECHANISM

BACKGROUND

1. Technical Field

The present disclosure relates to packing mechanisms, particularly to a packing mechanism having an adjustable volume for receiving workpieces.

2. Description of Related Art

Packing boxes are usually used for transporting workpieces conveniently. Many packing boxes, such as cardboard boxes, are configured to hold a fixed volume and are not adjustable. As a result, a new box needs to be designed or an oversized box with some filler material needs to be used for every different kind of work piece. Designing the new box or using an oversized box may incur additional costs. Current packing boxes may not be cost effective.

Therefore, there is room for improvement in the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
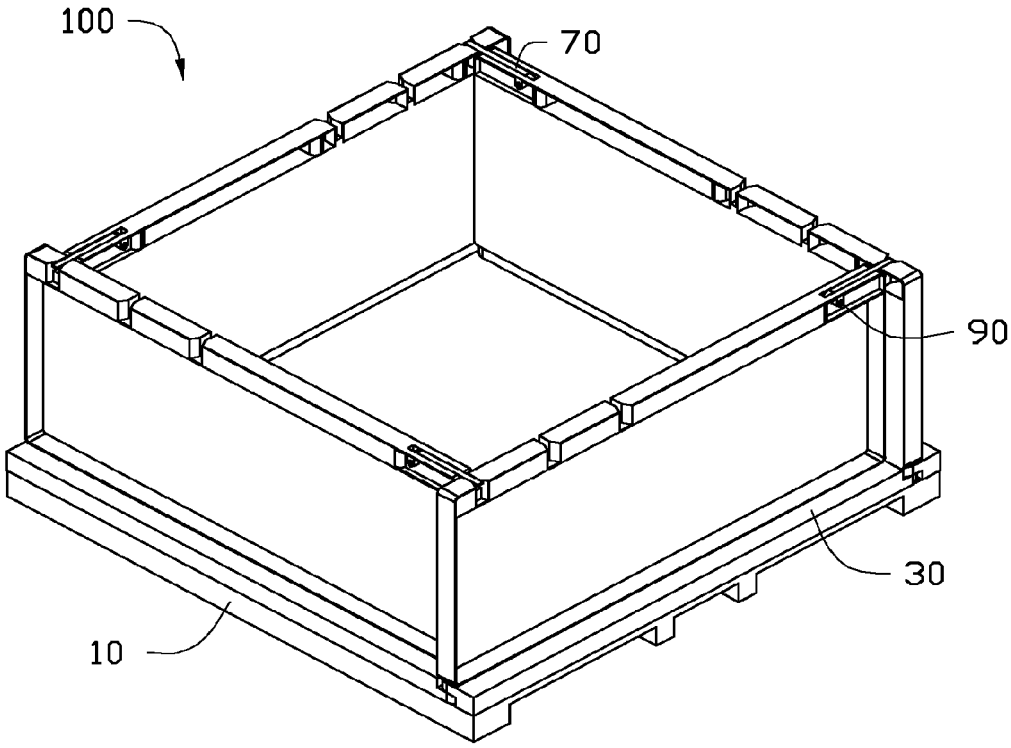
FIG. 1 is an isometric view of a first embodiment of a packing mechanism in a first state, the packing mechanism including a plurality of first connecting members and a plurality of sidewalls.

Referring to FIG. 1, a first embodiment of the packing mechanism 100 includes a plurality of first connecting members 30, a plurality of sidewalls 50, a plurality of second connecting members 70, and a plurality of locking members 90. The numbers of the plurality of first connecting members 30, the plurality of sidewalls 50, the plurality of second connecting members 70, and the plurality of locking members 90 are the same. The plurality of first connecting members 30 connect end to end to form a polygon. Each of the plurality of sidewalls 50 is mounted on corresponding one of the plurality of first connecting members 30. Each of the plurality of second connecting members 70 is mounted near one corner of one of the plurality of sidewalls 50 by one of the plurality of locking members 90 and latches to a corner of an adjacent one of the plurality of sidewalls 50. The packing mechanism 100 can be placed on floor, a pallet, a platform and so on. In the illustrated embodiment, the packing mechanism 100 is placed on a pallet 10.

In the first illustrated embodiment, the packing mechanism 100 is cube-shaped. There are four of the plurality of first connecting members 30. Accordingly, there are four each of the plurality of sidewalls 50, the plurality of second connecting members 70, and the plurality of locking members 90. The plurality of first connecting members 30 and the plurality of second connecting members 70 are made of metal, and the plurality of sidewalls 50 are made of plastic. If other shapes are desired, then the numbers of the members and sidewalls are adjusted accordingly, such as to three to achieve a triangular prism-shaped packaging mechanism 100 or six to achieve a hexagonal prism shaped packaging mechanism 100.

Figure 2:
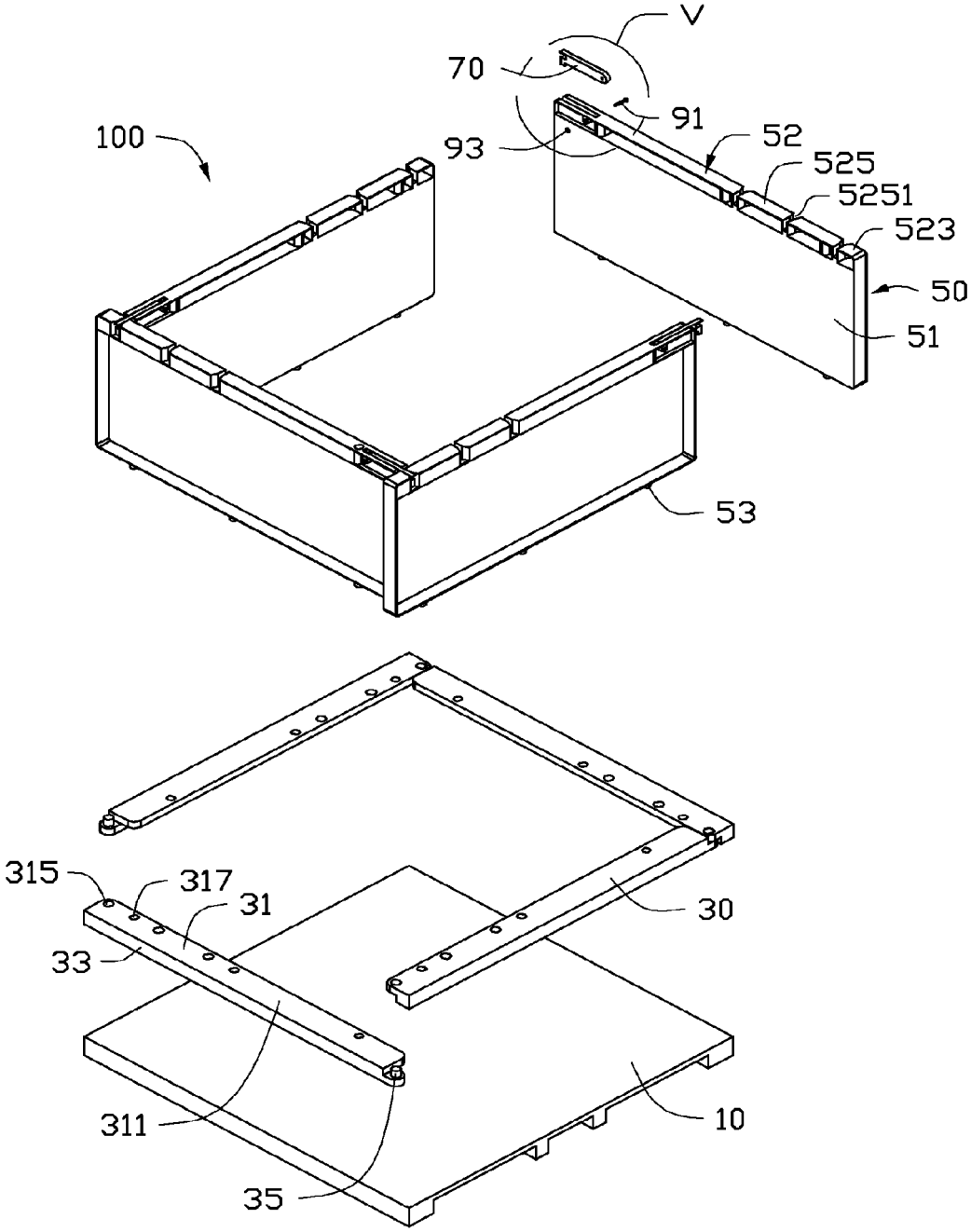
FIG. 2 is an exploded, isometric view of the packing mechanism shown in FIG. 1.
Figure 3:
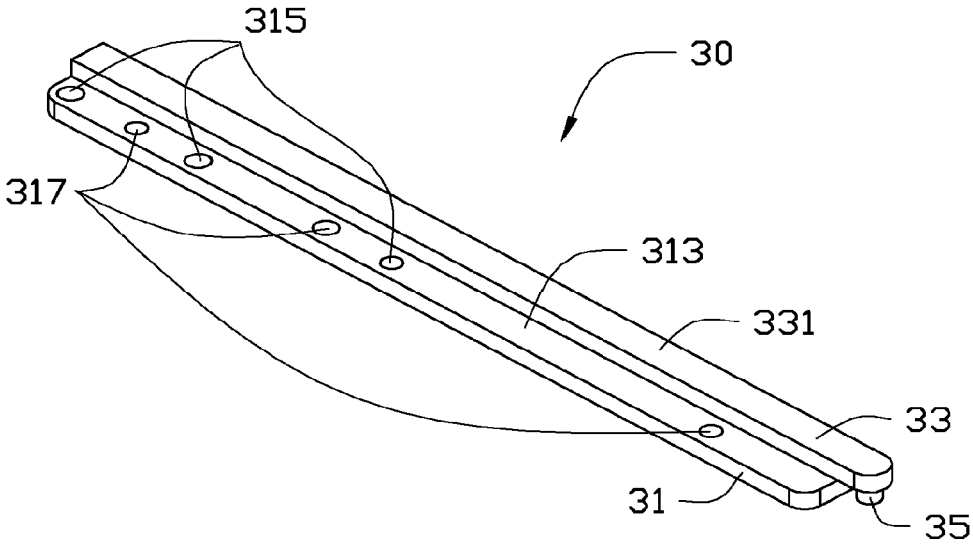
FIG. 3 is an enlarged, isometric view of one of the first connecting members of the packing mechanism shown in FIG. 1.

Referring to FIGS. 2 and 3, each of the plurality of first connecting members 30 includes a main body 31, an extending portion 33, and a fixing portion 35. The main body 31 is substantially a strip, and forms a first mounting surface 311 for a corresponding one of the plurality of sidewalls 50, and a second mounting surface 313 opposite to the first mounting surface 311. The extending portion 33 extends from the main body 31 away from each of the plurality of sidewalls 50. The first mounting surface 311 is parallel to the second mounting surface 313. The first mounting surface 311 defines at least two latching portions 315, for latching with the adjacent one of the plurality of first connecting members 30.

The first mounting surface 311 defines at least one connecting portion 317, for connecting to each of the plurality of sidewalls 50. In the illustrated embodiment, the at least two latching portions 315 and the at least one connecting portion 317 are a series of through holes alternated in a straight line. The distinction between the through holes is that beginning from the end away from the fixing portion 35 every other hole is one of the at least two latching portions 315 and the holes between each two of the at least two latching portions 315 is one of the at least one connection portion 317. In this embodiment there three each of the at least two latching portions 315 and the at least one connecting portion 317. It is noted that, the at least two latching portions 315 and the at least one connecting portion 317 can be blind holes.

The extending portion 33 extends from the second mounting surface 313 away from the first mounting surface 311. The extending portion 33 is substantially a strip, and forms a resisting surface 331 parallel to the first mounting surface 311 at a side away from the second mounting surface 313. The fixing portion 35 substantially perpendicularly protrudes from an end of the extending portion 33 towards the first mounting surface 311. In the illustrated embodiment, the fixing portion 35 is a protrusion engageable with any of the at least two latching portions 315 of adjacent one of the plurality of first connecting members 30, for connecting the plurality of first connecting members 30 with each other.

Figure 4:
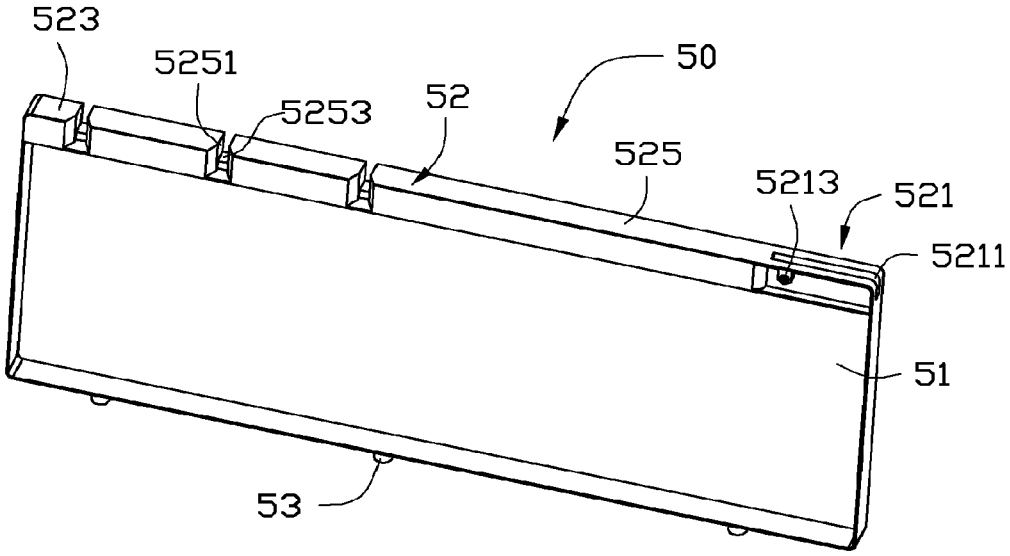
FIG. 4 is an enlarged, isometric view of one of the sidewalls of the packing mechanism shown in FIG. 1.

Referring to FIG. 4, each of the plurality of sidewalls 50 includes a base body 51, a connecting body 52, and at least one positioning portion 53. The connecting body 52 is formed at an end of the base body 51, and the at least one positioning portion 53 is formed at the opposite end of the base body 51. The number of the at least one positioning portion 53 equals to the number of the at least one connecting portion 317.

The base body 51 is substantially a rectangular plate. The connecting body 52 is integrated on the base body 51 at an end, and includes a first end portion 521, a second end portion 523 opposite to the first end portion 521, and a limiting portion 525 between the first end portion 521 and the second end portion 523. The first end portion 521 defines a receiving groove 5211 along the axis of the connecting body 52 at the surface opposite to the limiting portion 525, and a connecting through hole 5213 perpendicularly communicates with the receiving groove 5211. In the illustrated embodiment, the receiving groove 5211 reaches the surface of the second end portion 523 opposite to the at least one positioning portion 53. The receiving groove 5211 is strip shaped, and the connecting through hole 5213 is a through hole. The limiting portion 525 defines a plurality of limiting grooves 5251, and forms a plurality of limiting protrusions 5253 received in corresponding one of the plurality of limiting grooves 5251. The positions of the plurality of limiting grooves 5251 correspond to the position of each of the at least two latching portions 315 of each of the plurality of first connecting members 30. Each of the plurality of limiting protrusions 5253 is substantially a cuboid protrusion.

The at least one positioning portion 53 extends from the base body 51 away from the connecting body 52, and engage with the at least one connecting portion 317 of corresponding one of the plurality of first connecting members 30, for fixing each of the plurality of sidewalls 50 and the corresponding one of the plurality of first connecting members 30 together. In the illustrated embodiment, there are three positioning portions 53, and the positioning portions 53 are columnar protrusions corresponding to the at least one connecting portion 317. The three positioning portions 53 can be holes, and the at least one connecting portion 317 are protrusions corresponding to the three positioning portions 53.

Figure 5:
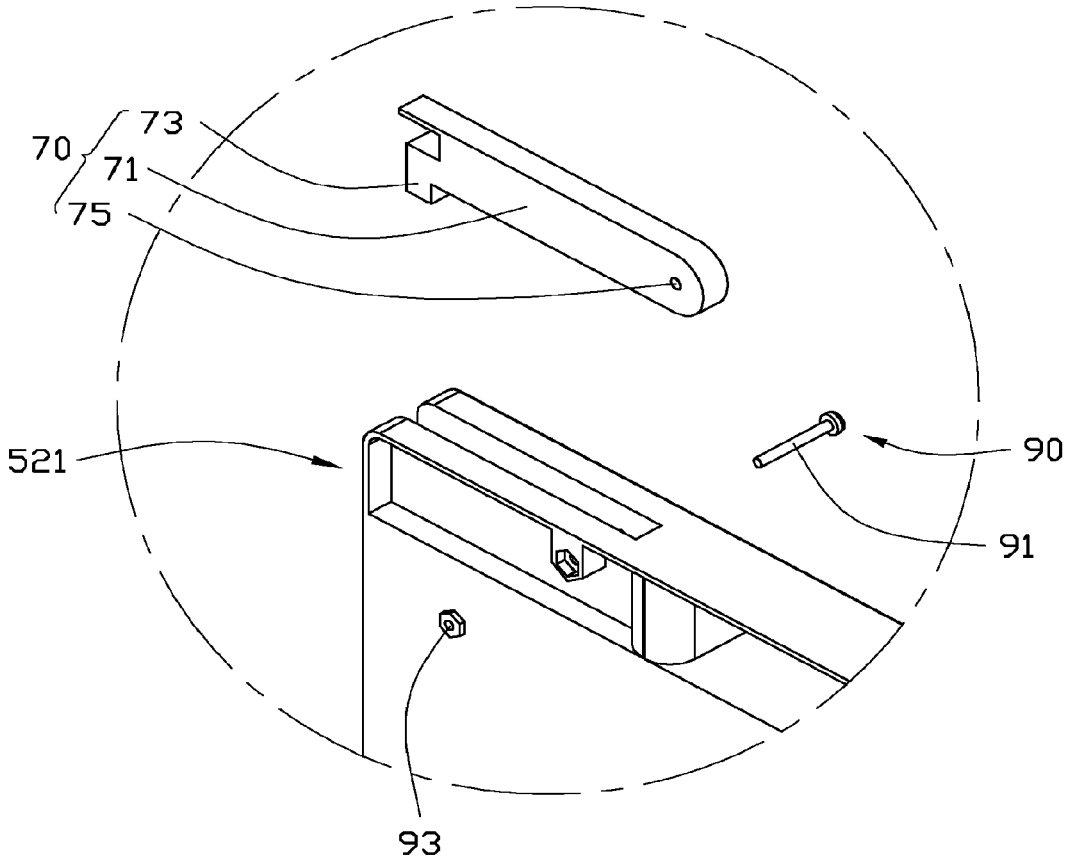
FIG. 5 is an enlarged, isometric view of a circled portion V of FIG. 2.

Referring to FIG. 5, each of the plurality of second connecting members 70 includes a bar 71 received in the receiving groove 5211, and a resisting portion 73 perpendicularly extending out from the bar 71. The bar 71 defines a fixing hole 75 at an end away from the resisting portion 73. The fixing hole 75 overlaps the connecting through hole 5213. The resisting portion 73 is latched with corresponding one of the plurality of limiting grooves 5251, and hooked on corresponding one of the plurality of limiting protrusions 5253. In the illustrated embodiment, the resisting portion 73 is a protrusion.

Each of the plurality of locking members 90 includes a locking portion 91 and a fastening portion 93 connected to the locking portion 91. The locking portion 91 is inserted through the connecting through hole 5213 and the fixing hole 75, and engages with the fastening portion 93 to fasten each of the plurality of sidewalls 50 and a corresponding one of the plurality of second connecting members 70, further to fix the plurality of sidewalls 50 to each other. In the illustrated embodiment, the plurality of locking members 90 are fasteners.

Referring to FIGS. 1 through 5, in assembly, firstly, the plurality of first connecting members 30 are placed on the pallet 10 end to end, and the fixing portion 35 of each of the plurality of first connecting members 30 is inserted into each of the at least two latching portions 315 away from the fixing portion 35 of adjacent one of the plurality of first connecting members 30, thus the plurality of first connecting members 30 are connected to be a square. Secondly, the plurality of sidewalls 50 are correspondingly mounted on the first mounting surfaces 311 of the plurality of first connecting members 30, and the at least one positioning portion 53 of each of the plurality of sidewalls 50 are latched with the at least one connecting portion 317 of a corresponding one of the plurality of first connecting members 30.

Thirdly, the bars 71 of the plurality of second connecting members 70 are received in the receiving groove 5211. Each of the resisting portion 73 is latched with corresponding one of the plurality of limiting grooves 5251, and hooked on corresponding one of the plurality of limiting protrusions 5253, and each of the fixing hole 75 overlaps the corresponding connecting through hole 5213. Finally, the locking portions 91 of the plurality of locking members 90 are inserted into the fixing holes 75 and the connecting through holes 5213, and the fastening portions 93 are engaged with the locking portions 91, to connect the plurality of sidewalls 50 end to end.

Figure 6:
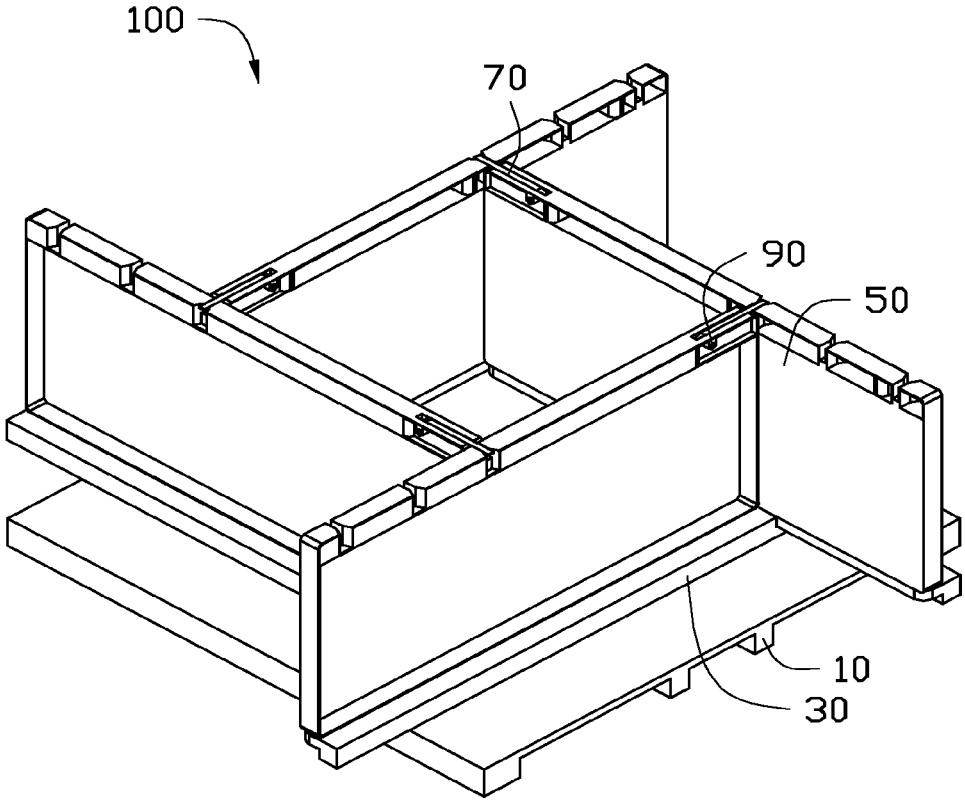
FIG. 6 is an isometric view of a second state of the packing mechanism shown in FIG. 1.
Figure 7:
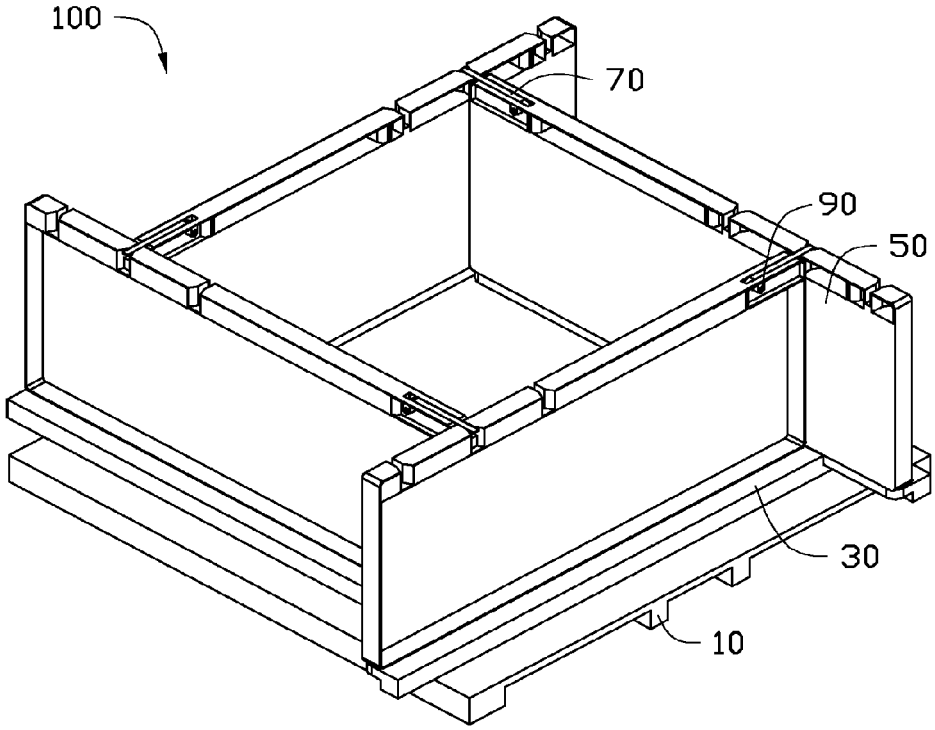
FIG. 7 is an isometric view of a third state of the packing mechanism shown in FIG. 1.

Referring to FIGS. 6 and 7, to adjust the capacity of the packaging mechanism 100, the fixing portion 35 of each of the plurality of first connecting members 30 is inserted into a different one of the at least two latching portions 315 of corresponding adjacent one of the plurality of first connecting members 30, and the resisting portion 73 is hooked on corresponding one of the plurality of limiting protrusions 5253. In FIG. 6 the fixing portion 35 of each of the plurality of first connecting members 30 is inserted into one of the at least two latching portions 315 near the fixing portion 35 of adjacent one of the plurality of first connecting members 30, to show the assembled packing mechanism 100 in a second state. In FIG. 7, the fixing portion 35 of each of the plurality of first connecting members 30 is inserted into middle one of the at least two latching portions 315 of adjacent one of the plurality of first connecting members 30, to show the assembled packing mechanism 100 in a third state.

Because each of the plurality of first connecting members 30 defines at least two latching members 315, and each of the at least two latching members 315 can engage with the corresponding fixing portion 35 the volume of the packing mechanism 100 is easily adjustable. In addition, the packing mechanism 100 is easy to be assembled and disassembled.

Figure 8:
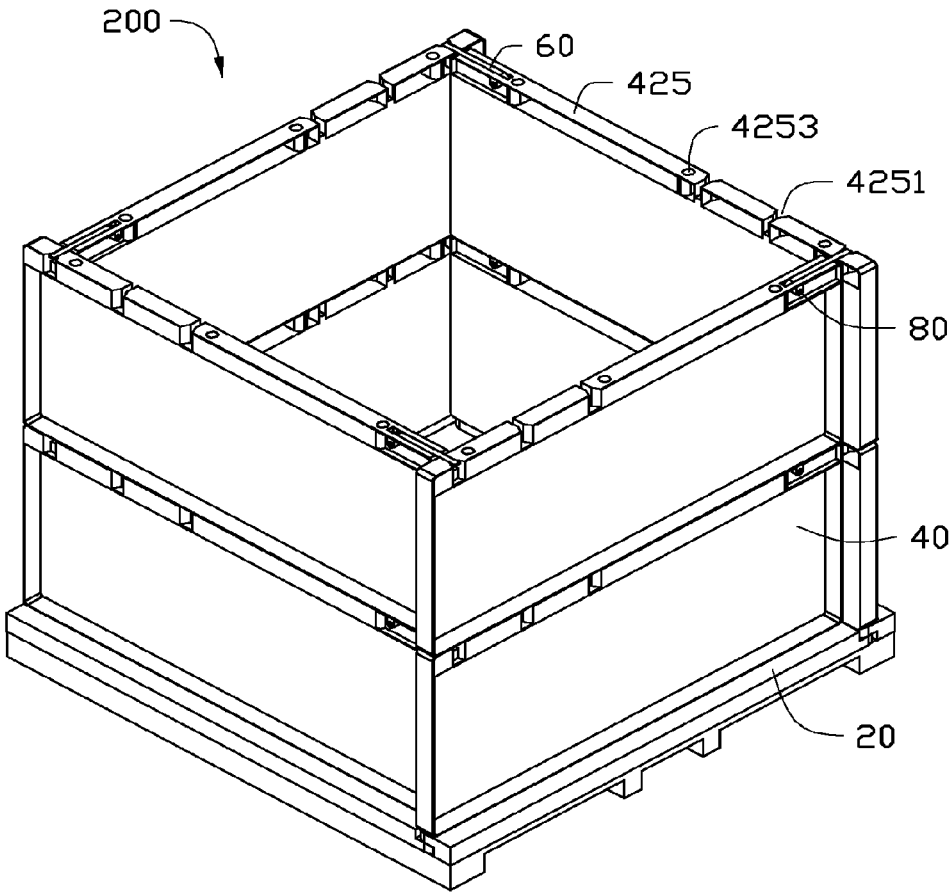
FIG. 8 is an isometric view of a second embodiment of a packing mechanism.

Referring to FIG. 8, a second embodiment of a packing mechanism 200 is similar to the packing mechanism 100 in the first embodiment. The limiting portion 425 defines a plurality of inserting portions 4253 at the side away from the positioning portions (not shown in FIG. 8) according to the position of the positioning portions. There are eight of the sidewalls 40, the second connecting members 60 and the locking members 80. In the illustrated embodiment, the inserting portions are holes according to the positioning portions. The assembling of the packing mechanism 200 is similar to the assembling of the packing mechanism 100, and the positioning portions of unassembled four of the sidewalls 40 are inserted into the plurality of inserting portions 4253 of the four assembled sidewalls. Unassembled four of the second connecting members 60 and four of the locking members 80 lock four of the sidewalls 40 cooperatively. Thus, the height of the packing mechanism 200 is twice of that of the packing mechanism 100.

If packaging mechanisms higher than the packaging mechanism 200 are desired, then the numbers of the members and sidewalls are adjusted accordingly, such as to twelve to achieve the packaging mechanisms higher than the packaging mechanism 200. It is noted that, the plurality of inserting portions 4253 can be protrusions, and the positioning portions are holes according to the plurality of inserting portions 4253. The first connecting members 20 can define one latching portion (not shown in FIG. 8), or the first connecting members 20 are fixed end to end, thus the base area of the packing mechanism 200 is unadjusted, and the volume of the packing mechanism 200 is adjusted by increase the height thereof.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A packing mechanism, comprising:

a plurality of first connecting members connecting end to end to form a polygon, each of the plurality of first connecting members comprising a main body and a fixing portion mounted on an end of the main body, the main body defining at least two latching portions and at least one connecting portion; and a plurality of sidewalls mounted on each of the plurality of first connecting members, each of the plurality of sidewalls comprising a base body and at least one positioning portion formed at an end of the base body, wherein the at least one positioning portion latches with the at least one connecting portion to connect each of the plurality of sidewalls with each of the plurality of first connecting members; the fixing portion engages with one of the at least two latching portions to connect with an adjacent one of the plurality of first connecting members; such that a volume of the packing mechanism is adjustable by engaging the fixing portion with another one of the at least two latching portions of the adjacent one of the plurality of first connecting members.

2. The packing mechanism of claim 1, wherein each of the plurality of sidewalls further comprises at least one inserting portion at a side away from the at least one positioning portion; the at least one inserting portion engages with the at least one positioning portion of one of the plurality of sidewalls to connect with an adjacent one of the plurality of sidewalls.

3. The packing mechanism of claim 1, further comprising a plurality of second connecting members, wherein each of the plurality of second connecting members comprises a bar and a resisting portion extending from an end of the bar; each of the plurality of sidewalls further comprises a connecting body at an end away from the at least one positioning portion; the connecting body comprises an end portion and a limiting portion connected to the end portion; the end portion defines a receiving groove on a surface opposite to the limiting portion, the limiting portion defines at least two limiting grooves located corresponding to the at least two latching portions; the bar is received in the receiving groove, and the resisting portion engages with the at least two limiting grooves of each of the plurality of sidewalls.

4. The packing mechanism of claim 3, wherein the limiting portion forms a limiting protrusion received in a corresponding limiting groove; the resisting portion is hooked with the limiting protrusion of one of the at least two limiting portions.

5. The packing mechanism of claim 4, wherein the end portion of each of the plurality of sidewalls further defines a connecting hole perpendicularly communicating with the receiving groove; the bar of each of the plurality of second connecting members defines a fixing hole at an end away from the resisting portion; the packing mechanism further comprises a plurality of locking members, and each of the plurality of locking members is inserted into each of the connecting holes and each of the fixing holes to connect each of the plurality of second connecting members with each of the plurality of sidewalls, thereby connecting the plurality of sidewalls with each other.

6. The packing mechanism of claim 1, wherein the fixing portion is a protrusion, and the at least two latching portions are holes.

7. The packing mechanism of claim 1, wherein the main body forms a first mounting surface and a second mounting surface opposite to the first mounting surface; the at least two latching portions are defined on the second mounting surface; the at least one connecting portion is defined on the first mounting surface; the first mounting surface resists each of the plurality of sidewalls.

8. The packing mechanism of claim 1, wherein each of the plurality of first connecting members further comprises an extending portion extending from the main body, the fixing portion protrudes from an end of the extending portion.

9. The packing mechanism of claim 1, wherein a number of the plurality of sidewalls is equal to a number of the plurality of first connecting members multiplied by an integer greater than one.

10. A packing mechanism, comprising:

a plurality of first connecting members connecting end to end to form a polygon; and a plurality of sidewalls mounted on each of the plurality of first connecting members, each of the plurality of sidewalls comprising a base body, at least one positioning portion formed at an end of the base body, and at least one inserting portion at a side away from the at least one positioning portion;

wherein the at least one inserting portion of each of the plurality of sidewalls engages with the at least one positioning portion of an adjacent one of the plurality of sidewalls, to connect each of the plurality of sidewalls with the adjacent one of the plurality of sidewalls together; a volume of the packing mechanism is adjustable by sandwiching sidewalls between each of the plurality of sidewalls.

11. The packing mechanism of claim 10, wherein each of the plurality of first connecting members comprises a main body, and a fixing portion mounted on an end of the main body; the main body defines at least two latching portions and at least one connecting portion; the at least one positioning portion latches with the at least one connecting portion to connect each of the plurality of sidewalls with each of the plurality of first connecting members; the fixing portion engages with one of the at least two latching portions to connect with an adjacent one of the plurality of first connecting members; such that the volume of the packing mechanism is adjustable by engaging the fixing portion with another one of the at least two latching portions of the adjacent one of the plurality of first connecting members.

12. The packing mechanism of claim 11, wherein each of the plurality of first connecting members further comprises an extending portion extending from the main body, the fixing portion protrudes from an end of the extending portion.

13. The packing mechanism of claim 11, further comprising a plurality of second connecting members, wherein each of the plurality of second connecting members comprises a bar and a resisting portion extending from an end of the bar; each of the plurality of sidewalls further comprises a connecting body at an end away from the at least one positioning portion; the connecting body comprises an end portion and a limiting portion connected to the end portion; the end portion defines a receiving groove on a surface opposite to the limiting portion, the limiting portion defines at least two limiting grooves located corresponding to the at least two latching portions; the bar is received in the receiving groove, and the resisting portion engages with the at least two limiting grooves of each of the plurality of sidewalls.

14. The packing mechanism of claim 13, wherein the limiting portion forms a limiting protrusion received in a corresponding limiting groove; the resisting portion is hooked with the limiting protrusion of one of the at least two limiting portions.

15. The packing mechanism of claim 14, wherein the end portion of each of the plurality of sidewalls further defines a connecting hole perpendicularly communicating with the receiving groove; the bar of each of the plurality of second connecting members defines a fixing hole at an end away from the resisting portion; the packing mechanism further comprises a plurality of locking members, and each of the plurality of locking members is inserted into each of the connecting holes and each of the fixing holes to connect each of the plurality of second connecting members with each of the plurality of sidewalls, thereby connecting the plurality of sidewalls with each other.

16. The packing mechanism of claim 10, wherein the fixing portion is a protrusion, and the at least two latching portions are holes.

17. The packing mechanism of claim 10, wherein the main body forms a first mounting surface and a second mounting surface opposite to the first mounting surface; the at least two latching portions are defined on the second mounting surface; the at least one connecting portion is defined on the first mounting surface; the first mounting surface resists each of the plurality of sidewalls.

18. The packing mechanism of claim 10, wherein a number of the plurality of sidewalls is equal to a number of the plurality of first connecting members multiplied by an integer greater than one.

* * * * *